US009192982B2

(12) United States Patent
Wilcox

(10) Patent No.: US 9,192,982 B2
(45) Date of Patent: Nov. 24, 2015

(54) FASTENER INSTALLATION TOOL WITH INTERNAL CONCENTRIC SLEEVES

(71) Applicant: Alcoa Inc., Pittsburgh, PA (US)

(72) Inventor: Robert Wilcox, Port Ewen, NY (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 14/631,085

(22) Filed: Feb. 25, 2015

(65) Prior Publication Data

US 2015/0239035 A1 Aug. 27, 2015

Related U.S. Application Data

(60) Provisional application No. 61/944,673, filed on Feb. 26, 2014.

(51) Int. Cl.

| | |
|---|---|
| ***B21J 15/34*** | (2006.01) |
| ***B21J 15/10*** | (2006.01) |
| ***B21J 15/16*** | (2006.01) |
| ***B21J 15/22*** | (2006.01) |

(52) U.S. Cl.

CPC ..... *B21J 15/105* (2013.01); *B21J 15/16* (2013.01); *B21J 15/22* (2013.01); *B21J 15/34* (2013.01)

(58) Field of Classification Search

CPC ..... B21J 15/105; B21J 15/16; B21J 15/34; B21J 15/22

See application file for complete search history.

(56) References Cited

U.S. PATENT DOCUMENTS

| | | | |
|---|---|---|---|
| 3,713,321 | A | 1/1973 | LaPointe |
| 4,454,746 | A | 6/1984 | Schwab |
| 4,515,005 | A | 5/1985 | Klein |
| 4,580,435 | A | 4/1986 | Port et al. |
| 4,597,263 | A | 7/1986 | Corbett |
| 4,615,206 | A | 10/1986 | Rosier |
| 4,796,455 | A | 1/1989 | Rosier |
| 4,813,261 | A | 3/1989 | Rosier |
| 4,878,372 | A | 11/1989 | Port et al. |
| 5,371,933 | A | 12/1994 | Godfrey |
| 5,485,727 | A | 1/1996 | Godfrey |
| 6,739,170 | B1 | 5/2004 | Rosier |

(Continued)

FOREIGN PATENT DOCUMENTS

| | | | |
|---|---|---|---|
| EP | 0154280 | A2 | 9/1985 |
| GB | 2301547 | A | 12/1996 |

OTHER PUBLICATIONS

International Search Report and Written Opinion, dated Jun. 15, 2015, issued by the European Patent Office in International (PCT) Application No. PCT/US2015/017478 (9 pages).

(Continued)

*Primary Examiner* — David B Jones

(74) *Attorney, Agent, or Firm* — Greenberg Traurig, LLP

(57) ABSTRACT

A fastener installation tool including a cylinder assembly having a housing and a handle/sleeve assembly attached to the housing. The handle/sleeve assembly includes a handle having a bore and an inner wall defined by the bore. The handle/sleeve assembly further includes an outer sleeve having an outer wall and an inner wall, and an inner sleeve having an outer wall and an inner wall. The outer sleeve is positioned within the bore of the handle, while the inner sleeve is positioned concentrically within the outer sleeve to form an annular space between the outer wall of the inner sleeve and the inner wall of the outer sleeve. The annular space is utilized to conduct hydraulic fluid.

14 Claims, 4 Drawing Sheets

(56) References Cited

U.S. PATENT DOCUMENTS

| | | | | |
|---|---|---|---|---|
| 7,458,245 | B1 | 12/2008 | Wilcox | |
| 7,631,534 | B2 | 12/2009 | Wilcox | |
| 2015/0014014 | A1* | 1/2015 | Wilcox | B21J 15/105 173/218 |

OTHER PUBLICATIONS

"Huck, Lockbolts, Structural Blind Rivets and Tooling Catalog", Alcoa Fastening Systems, pp. 1-51 (2014).

* cited by examiner

FASTENER INSTALLATION TOOL WITH INTERNAL CONCENTRIC SLEEVES

CROSS-REFERENCE TO RELATED APPLICATION

This application is a Section 111(a) application relating to and claiming the benefit of commonly owned, U.S. Provisional Patent Application Ser. No. 61/944,673 entitled "FASTENER INSTALLATION TOOL WITH INTERNAL CONCENTRIC SLEEVES," filed Feb. 26, 2014, the entirety of which is incorporated herein by reference.

FIELD OF THE INVENTION

The present invention relates to installation tools and, more particularly, to fastener installation tools, including, but not limited to, hydraulic and pneumatic fastener installation tools having internal concentric sleeves.

BACKGROUND OF THE INVENTION

Fastener installation tools are utilized to install fasteners to secure a plurality of work pieces to one another. The fasteners may be conventional pull-type fasteners which include a separable pintail portion engageable by a nose assembly of the tool. It is desirable to provide a relatively lightweight, less expensive fastener installation tool.

SUMMARY OF THE INVENTION

In an embodiment, a fastener installation tool comprises a cylinder assembly, a handle/sleeve assembly, and a tool handle. In an embodiment, the cylinder assembly includes a housing having an upper end and a lower end opposite the upper end, an end cap mounted to the upper end of the housing. In an embodiment, the end cap includes a first surface, a second surface opposite the first surface, and a centrally-located bore extending from the first surface to the second surface. In an embodiment, the handle/sleeve assembly includes a handle having a first end, and a second end opposite the first end, a bore extending between the first and second ends, and an inner wall defined by the bore of the handle. In an embodiment, the second end of the handle/sleeve assembly is attached to the upper end of the cylinder assembly. In an embodiment, the handle/sleeve assembly further includes an outer sleeve having a first end, a second end opposite the first end of the outer sleeve, an outer wall, and an inner wall. In an embodiment, the outer sleeve is positioned within the bore of the handle. In an embodiment, the handle/sleeve assembly further includes an inner sleeve having a first end, a second end opposite the first end of the inner sleeve, an outer wall, and an inner wall. In an embodiment, the inner sleeve is positioned concentrically within the outer sleeve to form an annular space between the outer wall of the inner sleeve and the inner wall of the outer sleeve. In an embodiment, the tool head is attached to the first end of the handle.

In an embodiment, the annular space is adapted to receive a volume of hydraulic fluid. In an embodiment, the tool head includes a housing having an interior portion and a passage providing a fluid connection between the annular space of the handle/sleeve assembly and the interior portion of the housing of the tool head. In an embodiment, the passage includes a plurality of passages. In an embodiment, the outer wall of the outer sleeve includes an external thread located proximate to the first end of the outer sleeve. In an embodiment, the tool head includes a neck having an internal thread that engages threadedly the external thread of the outer sleeve. In an embodiment, the inner sleeve includes an oil passage providing a fluid connection between the annular portion and an internal bore of the inner sleeve.

In an embodiment, the outer sleeve includes a gland portion positioned proximate to the second end of the outer sleeve. In an embodiment, the second surface of the end cap of the cylinder assembly includes a centrally-located depression positioned concentrically around the bore. In an embodiment, the centrally-located depression is adapted to receive the gland portion. In an embodiment, the end cap of the cylinder assembly includes a threaded member adapted to mate with the external thread of the gland portion. In an embodiment, the threaded member includes a nut. In an embodiment, the outer sleeve includes an annular flanged portion positioned proximate to the second end of the outer sleeve. In an embodiment, the annular flanged portion of the outer sleeve, the gland portion, and the bore of the end cap form a cavity that is adapted to receive an O-ring.

In an embodiment, one of the outer sleeve and the inner sleeve is fabricated from steel. In an embodiment, the handle is fabricated from plastic.

DETAILED DESCRIPTION OF THE DRAWINGS

Figure 1:
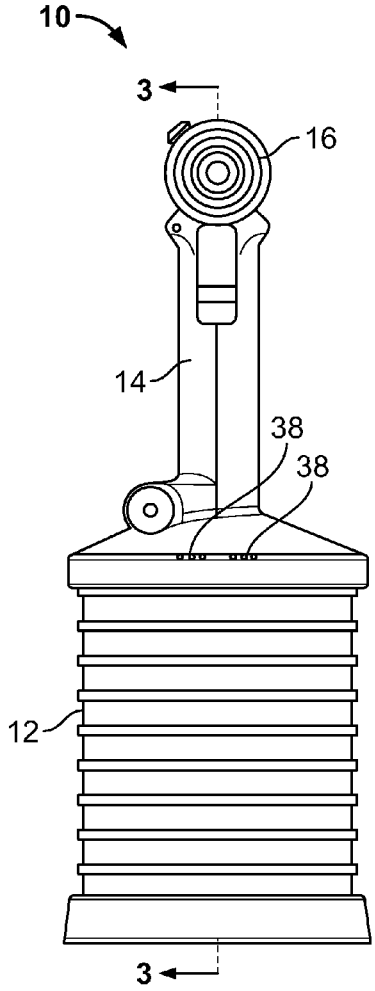
FIG. 1 is a front elevational view of an embodiment of a fastener installation tool.
Figure 2:
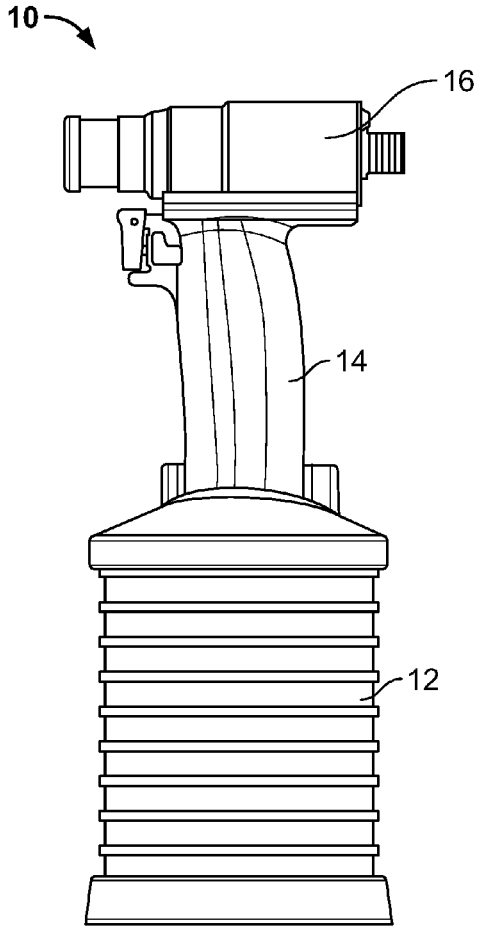
FIG. 2 is a side elevational view of the fastener installation tool shown in FIG. 1.

Referring to FIGS. 1 and 2, in an embodiment, a fastener installation tool 10 includes a cylinder assembly 12, a handle 14, and a hydraulically actuated driving tool head 16. In an embodiment, the handle 14 is trap fit between the cylinder assembly 12 and the tool head 16. In various embodiments, certain features and components of the fastener installation tool 10 may be similar in structure and function to Huck® fastener installation tools, model numbers 246, 256, 244, 245, or 255 manufactured by Alcoa Fastening Systems. For the sake of brevity, a discussion of each and every component and feature of the fastener installation tool 10 shown in the Figures will not be provided.

Figure 3:
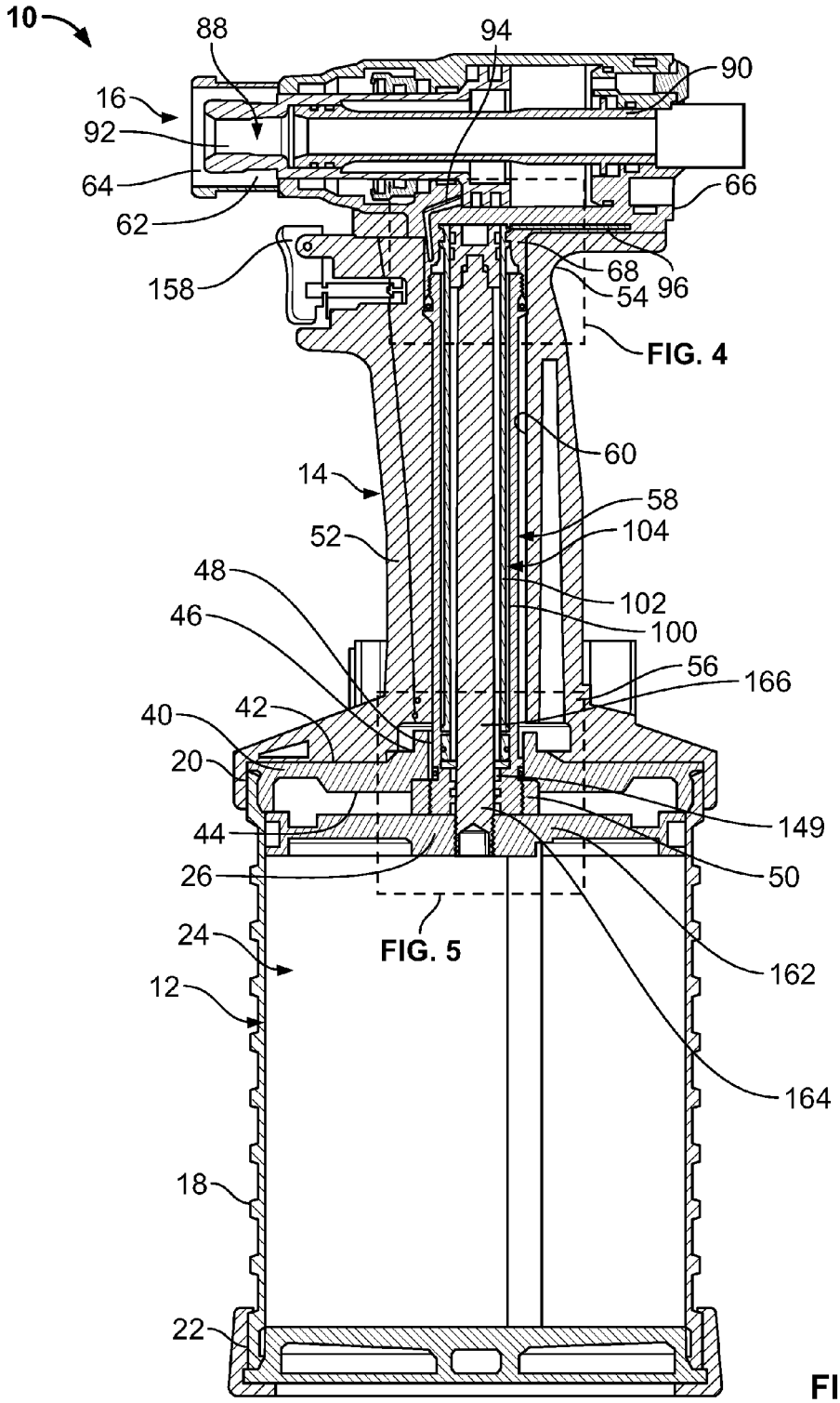
FIG. 3 is a side cross-sectional view, taken along section lines A-A and looking in the direction of the arrows, of the fastener installation tool shown in FIG. 1.

Referring to FIG. 3, in an embodiment, the cylinder assembly 12 includes a housing 18 having an upper end 20 and a lower end 22 opposite the upper end 20, the handle 14 being mounted to the upper end 20 of the cylinder assembly 12. In an embodiment, the cylinder assembly 12 includes an interior portion 24 that is sized and shaped to house an air piston 26 that is movably disposed therein, and which will be described in further detail below. In an embodiment, the cylinder assembly 12 includes an end cap 40 mounted to the upper end 20 of the housing 18. In an embodiment, the end cap 40 includes a first surface 42 a second surface 44 opposite the first surface 42, a centrally-located annular portion 46 extending from the first surface 42 and having a centrally-located bore 48 extending from the first surface 42 to the second surface 44, and a centrally-located depression 50 formed within the second surface 44 and positioned concentrically around the bore 48.

Still referring to FIG. 3, in an embodiment, the handle 14 includes an elongated portion 52 having a first end 54 and a second end 56 opposite the first end 54, and a centrally-located bore 58 that extends from the first end 54 to the second end 56 of the elongated portion 52. In an embodiment, the bore 58 is substantially cylindrical in shape and forms an inner wall 60. In an embodiment, the handle 14 includes an exhaust vent 38 (see FIG. 1). In an embodiment, the exhaust vent 38 includes a plurality of holes which extend from an exterior surface to an interior surface of the handle 14.

Figure 4:
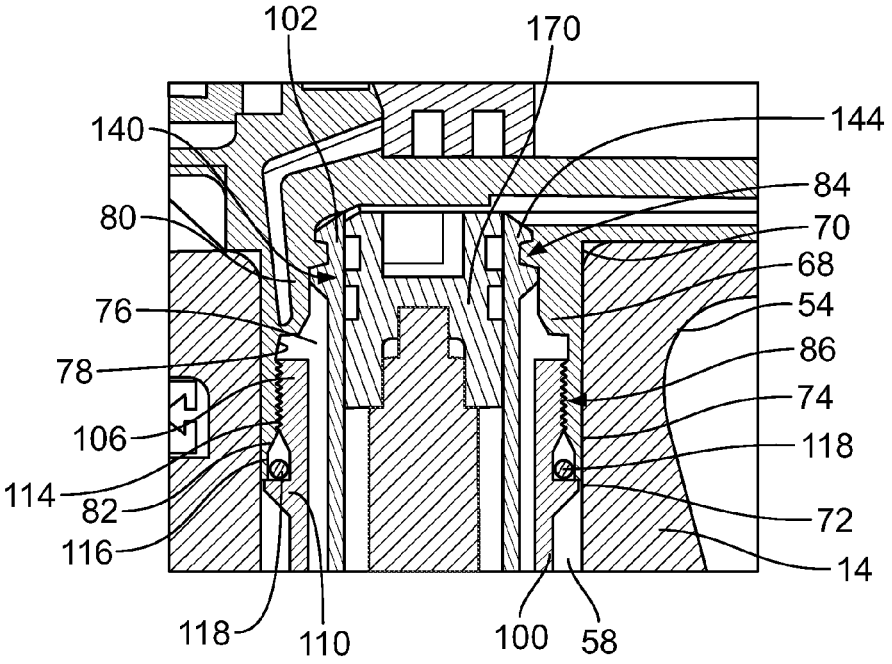
FIG. 4 is an enlarged view of Detail A shown in FIG. 3.

Still referring to FIG. 3, in an embodiment, the tool head 16 includes a housing 62 having a first end 64, a second end 66 opposite the first end 64, and a neck 68 extending outwardly from the housing 62 intermediate the first and second ends 64, 66. Referring to FIG. 4, in an embodiment, the neck 68 is cylindrical in shape and includes a first end 70 and a second, free end 72 opposite the first end 70. In an embodiment, the neck 68 includes an outer wall 74 and an internal cavity 76 extending from the first and second ends 70, 72, which forms an inner wall 78. In an embodiment, the inner wall 78 includes a first stepped portion 80 extending therefrom and located intermediate the first and second ends 70, 72 of the neck 68, and a second stepped portion 82 extending inwardly therefrom and located proximate to the second, free end 72 of the neck 68. In an embodiment, the first stepped portion 80 includes an annular seal 84. In an embodiment, the inner wall 78 of the neck 68 includes an internal thread 86 located intermediate the first and second ends 70, 72 thereof. In an embodiment, the neck 68 is sized and shaped to mate with and fit within the bore 58 of the handle 14 at the first end 54 thereof for attachment of the tool head 16 to the handle 14.

Referring back to FIG. 3, in an embodiment, the housing 62 of the tool head 16 includes an interior portion 88, and housed within the interior portion 88 is a pull piston 90 and a nose assembly 92 attached thereto. In an embodiment, the pull piston 90 is a double acting hydraulic piston. In an embodiment, the pull piston 90 and the nose assembly 92 are moveable between a forward home position and a backward engaged position, which will be described in further detail below. In an embodiment, the nose assembly 92 includes a collet and an anvil that are adapted to engage and install a fastener (not identified in the Figures). In an embodiment, one side of the neck 68 of the tool head 16 includes a first oil passage 94 extending from the bore 58 of the handle 14 to the interior portion 88 of the housing 62 of the tool head 16. In an embodiment, the first oil passage 94 consists of a plurality of passages. In an embodiment, the tool head 16 includes a second oil passage 96 extending from the bore 58 of the handle 14 to the interior portion 88 of the housing 62 of the tool head 16. In an embodiment, the second oil passage 96 consists of a plurality of oil passages.

Figure 6:
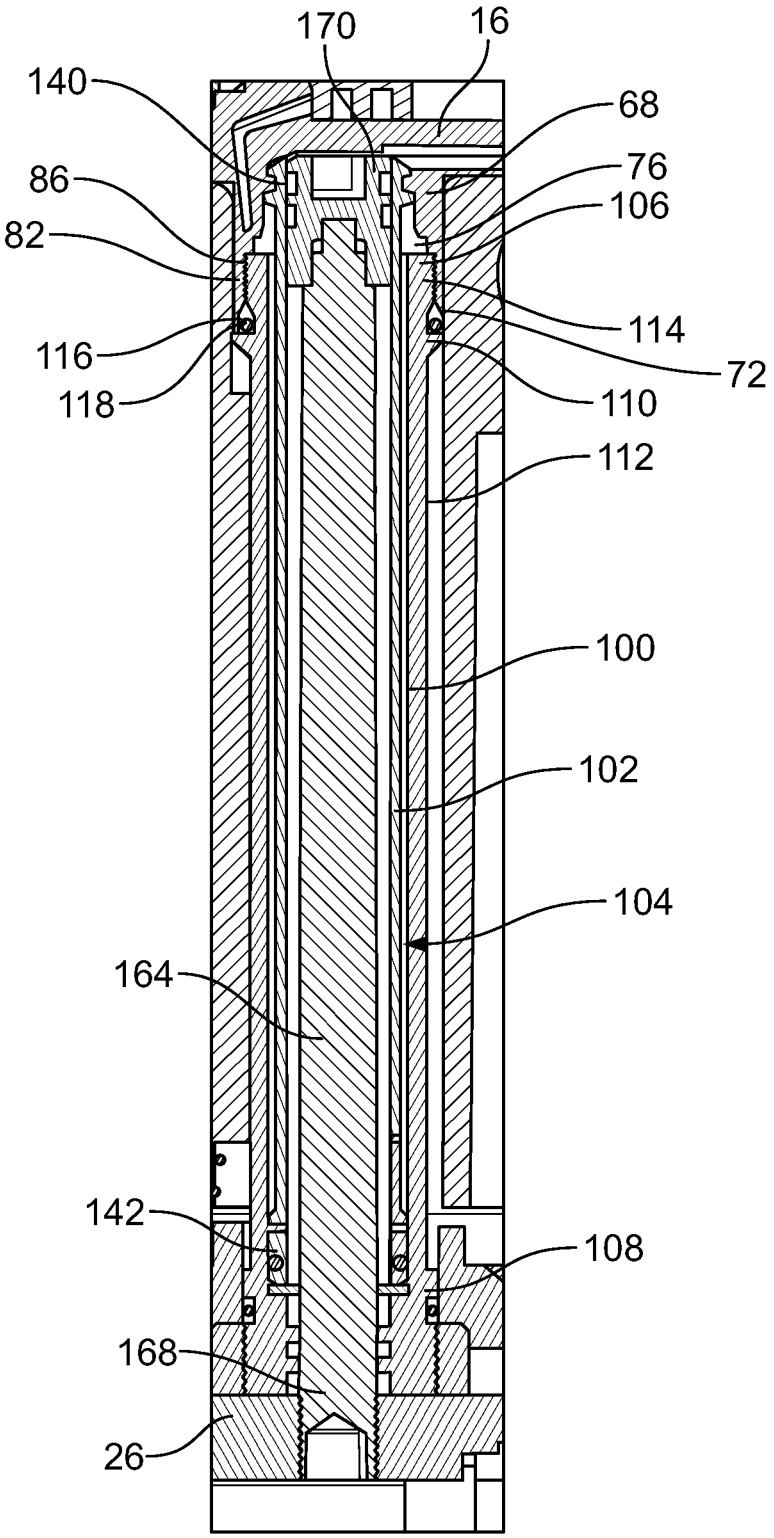
FIG. 6 is an enlarged cross-sectional view of a portion of a handle of the fastener installation tool shown in FIG. 3.

With continued reference to FIG. 3, in an embodiment, the handle 14 includes a tubular outer sleeve 100 positioned within the bore 58 of the handle 14, and a tubular inner sleeve 102 positioned concentrically within the outer sleeve 100. In an embodiment, an annular space 104 is formed between the outer sleeve 100 and the inner sleeve 102. Referring to FIGS. 4 and 6, in an embodiment, the outer sleeve 100 includes a first end 106 and a second end 108 opposite the first end 106, an annular flanged portion 110 extending outwardly from an outer wall 112 of the outer sleeve 100 and located proximate to the first end 106, and an external thread 114 positioned proximate to the first end 106 thereof. In an embodiment, the first end 106 of the outer sleeve 100 is attached to the neck 68 of the tool head 16. In an embodiment, the first end 106 of the outer sleeve 100 is fitted within the internal cavity 76 of the neck 68, and the external thread 114 of the outer sleeve 100 engages threadedly the internal thread 86 of the neck 68. In an embodiment, the flanged portion 110 of the outer sleeve 100 engages and abuts against the second, free end 72 of the neck 68 of the tool head 16. In an embodiment, the second step portion 82 of the neck 68 of the tool head 16 and the flanged portion 110 and outer wall 112 of the outer sleeve 100 form a cavity 116 that is sized and shaped to receive a seal 118 (e.g., an O-ring).

Figure 5:
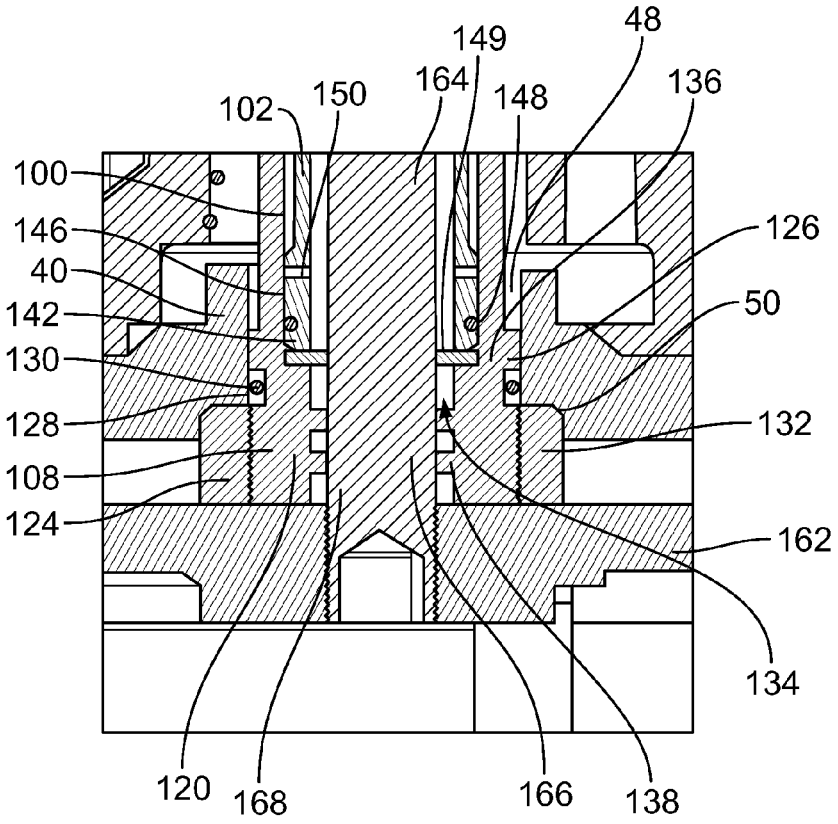
FIG. 5 is an enlarged view of Detail B shown in FIG. 3.

Referring to FIG. 5, in an embodiment, the second end 108 of the outer sleeve 100 includes a gland portion 120, an external thread 124 located proximate to the second end 108, an annular flanged portion 126 positioned proximate to the second end 108, and an annular cavity 128 positioned intermediate the flanged portion 126 and the second end 108. In an embodiment, the cavity 128 is sized and shaped to receive a seal 130 (e.g., O-ring). In an embodiment, the gland portion 120 is positioned within the bore 48 of the end cap 40 of the cylinder assembly 12, such that the external thread 124 of the gland portion 120 extends outwardly from the depression 50 of the end cap 40. In an embodiment, a threaded member (e.g., a threaded nut) 132 engages the external thread 124 of the gland portion 120 to secure it to the end cap 40. In an embodiment, the handle 14 is trap fit between the assembly of head 20 and outer and inner sleeves 100, 102 and the end cap 40 of the cylinder assembly 12 and secured in place by the nut 132. In an embodiment, the gland portion 120 includes an internal bore 134, an internal annular step portion 136, and an internal retainer portion 138.

Referring to FIG. 6, in an embodiment, the inner sleeve 102 includes a first end 140 and a second end 142 opposite the first end 140. In an embodiment, the first end 140 of the inner sleeve 102 is attached to the second end 72 of the neck 68. Referring back to FIG. 4, in an embodiment, the first end 140 of the inner sleeve 102 includes a dual-annular flanged portion 144 that engages the seal 84 of the first step portion 80 of the neck 68 of the head 16. Referring back to FIG. 5, in an embodiment, the second end 142 of the inner sleeve 102 includes a dual-annular flanged portion 146 and a seal 148 (e.g., O-ring) positioned therebetween. In an embodiment, the second end 142 of the inner sleeve 102 abuts against a washer 149 located intermediate the inner sleeve 102 and the step portion 136 of the gland portion 120 of the outer sleeve 100. In an embodiment, the second end 142 of the inner sleeve 102 includes an oil passage 150 that is in communication with the annular space 104 between the outer sleeve 100 and the inner sleeve 102.

Referring to FIGS. 3 and 5, the piston 26 includes a piston head 162 and an intensifier rod 164 extending therefrom. In an embodiment, the intensifier rod 164 includes a shank 166 that is positioned slidably through the bore 134 of the gland portion 120 of the outer sleeve 100 and through the inner sleeve 102. In an embodiment, one end of the shank 166 of the rod 164 includes a head 168 (see FIGS. 4 and 6), and an opposite, free end of the rod 164 engages an intensifier piston 170 that is positioned within the inner sleeve 102 (see FIG. 4). In an embodiment, a trigger 158 is pivotally mounted on the handle 14. In an embodiment, the housing 18 of the cylinder assembly 12 is made of aluminum, the housing 62 of the tool head 16 is made of stainless steel, the outer sleeve 100 and the inner sleeve 102 are each made from steel, and the handle 14 is made of plastic. In other embodiments, each of the foregoing components may be made from other suitable materials known within the fastener installation tool art.

In an embodiment, when the trigger 158 is depressed, pressurized air is directed to the top of the piston head 162, causing it to move downward. The air below the piston head 162 is exhausted out the air exhaust vent 38 of the handle 14.

When the piston 26 moves downward, a column of pressurized hydraulic fluid (such as oil) is forced up through the annular space 104 between the inner sleeve 102 and the outer sleeve 100 into the tool head 16 via the first and second oil passages 94, 96, which moves the pull piston 90 to its backward engaged position. In turn, the nose assembly 92 moves along with the pull piston 90 to the backward engaged position in order to commence fastener installation.

When fastener installation is completed, the trigger 158 is released, pressurized air is re-directed to the bottom of the piston head 162, causing it, along with the intensifier rod 164, to move upwardly. The air from above the piston head 162 is exhausted through the air exhaust vent 38 of the handle 14. As this occurs, hydraulic pressure is reversed and the pull piston 90 and nose assembly 92 are returned to their forward home position.

In an embodiment, the annular space 104 between the inner sleeve 102 and the outer sleeve 100 is utilized to conduct the hydraulic fluid, which allows the handle 14 to be constructed from a relatively lightweight material, since the handle 14 is only subject to pneumatic pressures, rather than both pneumatic pressures and hydraulic pressures. Thus, the handle 14 can be made with relatively inexpensive materials, such as plastic, and deep drilling of high strength materials to construct the handle 14 is not required. In an embodiment, the annular/cylindrical volume of oil in the space 104 between the outer and inner sleeves 100, 102 acts as a shock dampener when pin break of the fastener occurs, thus reducing vibration and shock to the user of the tool 10.

It should be understood that the embodiments described herein are merely exemplary and that a person skilled in the art may make many variations and modifications without departing from the spirit and scope of the invention. All such variations and modifications are intended to be included within the scope of the invention.

What is claimed is:

1. A fastener installation tool, comprising:

a cylinder assembly including a housing having an upper end and a lower end opposite the upper end, an end cap mounted to the upper end of the housing, the end cap including a first surface, a second surface opposite the first surface, and a centrally-located bore extending from the first surface to the second surface;

a handle/sleeve assembly including a handle having a first end, and a second end opposite the first end, a bore extending between the first and second ends, and an inner wall defined by the bore of the handle, the second end of the handle/sleeve assembly being attached to the upper end of the cylinder assembly, the handle/sleeve assembly further including an outer sleeve having a first end, a second end opposite the first end of the outer sleeve, an outer wall, and an inner wall, wherein the outer sleeve is positioned within the bore of the handle, the handle/sleeve assembly further including an inner sleeve having a first end, a second end opposite the first end of the inner sleeve, an outer wall, and an inner wall, wherein the inner sleeve is positioned concentrically within the outer sleeve to form an annular space between the outer wall of the inner sleeve and the inner wall of the outer sleeve; and a tool head attached to the first end of the handle.

2. The fastener installation tool of claim 1, wherein the annular space is adapted to receive a volume of hydraulic fluid.

3. The fastener installation tool of claim 1, wherein the tool head includes a housing having an interior portion and a passage providing a fluid connection between the annular space of the handle/sleeve assembly and the interior portion of the housing of the tool head.

4. The fastener installation tool of claim 3, wherein the passage includes a plurality of passages.

5. The fastener installation tool of claim 1, wherein the outer wall of the outer sleeve includes an external thread located proximate to the first end of the outer sleeve, and wherein the tool head includes a neck having an internal thread that engages threadedly the external thread of the outer sleeve.

6. The fastener installation tool of claim 1, wherein the inner sleeve includes an oil passage providing a fluid connection between the annular portion and an internal bore of the inner sleeve.

7. The fastener installation tool of claim 1, wherein the outer sleeve includes a gland portion positioned proximate to the second end of the outer sleeve.

8. The fastener installation tool of claim 7, wherein the second surface of the end cap of the cylinder assembly includes a centrally-located depression positioned concentrically around the bore, the centrally-located depression being adapted to receive the gland portion.

9. The fastener installation tool of claim 8, wherein the end cap of the cylinder assembly includes a threaded member adapted to mate with the external thread of the gland portion.

10. The fastener installation tool of claim 9, wherein the threaded member includes a nut.

11. The fastener installation tool of claim 7, wherein the outer sleeve includes an annular flanged portion positioned proximate to the second end of the outer sleeve.

12. The fastener installation tool of claim 11, wherein the annular flanged portion of the outer sleeve, the gland portion, and the bore of the end cap form a cavity that is adapted to receive an O-ring.

13. The fastener installation tool of claim 1, wherein one of the outer sleeve and the inner sleeve is fabricated from steel.

14. The fastener installation tool of claim 1, wherein the handle is fabricated from plastic.

* * * * *